US005823205A

United States Patent [19]

Stankovic

[11] Patent Number: 5,823,205

[45] Date of Patent: Oct. 20, 1998

[54] NAIL FILING GUIDE

[76] Inventor: Bill Stankovic, 526 Bryant St., Palo Alto, Calif. 94301

[21] Appl. No.: 900,770

[22] Filed: Jul. 25, 1997

[51] Int. Cl.[6] ..... A45D 29/00

[52] U.S. Cl. ..... 132/285; 132/73; 132/73.5

[58] Field of Search ..... 132/285, 73, 73.5, 132/75.3, 200

[56] References Cited

U.S. PATENT DOCUMENTS

| | | | |
|---|---|---|---|
| 2,257,102 | 9/1941 | Breene | 132/285 |
| 2,485,384 | 10/1949 | Klein | 132/285 |
| 4,287,899 | 9/1981 | Robichaud | 132/73 |
| 4,690,369 | 9/1987 | Giuliano | 132/73 |
| 5,613,507 | 3/1997 | Geer et al. | 132/73 |

*Primary Examiner*—Gene Mancene
*Assistant Examiner*—Pedro Philogene
*Attorney, Agent, or Firm*—Townsend and Townsend and Crew LLP; Kenneth R. Allen

[57] ABSTRACT

According to the present invention, a nail filing guide is provided for controlling the shape and quality of symmetry of a nail, particularly a fingernail. The nail filing guide comprises a digit rest and a shape wall; the shape wall having an outer contour defining a desired nail shape and a thickness size to accommodate the size of the nail. The outer contour of the wall has an angle established to shape a nail perpendicular to the growth pattern of the nail and a contour to accommodate the desired contour of the nail. Specific embodiments of the nail guides include a pointed contour, a blunt contour, a so-called opaque contour, and a round contour. Extending outward from the shape wall is a support porch for guiding a nail file rested against the support porch. Importantly, the tip of the shape wall is curved to conform generally to the natural lateral curve of the nail.

20 Claims, 2 Drawing Sheets

NAIL FILING GUIDE

BACKGROUND OF THE INVENTION

The present invention relates to devices for use in shaping nails. More particularly, the invention provides a device for manicuring fingernails consistently and easily.

Properly shaped nails have heretofore required the skills of a professional manicurist or pedicurist. As a consequence, proper nail preparation has been relatively expensive and time-consuming. Therefore, there is a need to provide some mechanism for promoting proper nail preparation and for allowing the casual and unskilled user to perform an efficient manicure or pedicure of high quality, at a low cost. Also, it would be advantageous to be able to quickly control the shape and symmetry of a nail, while still promoting the proper growth pattern, after the nail has broken unexpectedly.

SUMMARY OF THE INVENTION

According to the present invention, a nail filing guide is provided for controlling the shape and quality of symmetry of a nail. The nail filing guide comprises a grippable structure having a first and second opposing digit rest, the digit rests being typically of different size in depth and width, and having shape walls; the shape walls having an outer contour defining a desired nail shape and a thickness size to accommodate the minimum length of the nail. The outer contour of the shape walls have an angle established to shape a nail perpendicular to the growth pattern of the nail and a contour to accommodate the desired shape of the nail. Specific embodiments of the nail guides include a generally pointed contour, a blunt contour, a so-called opaque contour, and a round contour. Each of these contours being readily identifiable by some form of designation on the structure itself, such as color or external marking or a general shape of the structure. Extending outward from the intersection of the shape walls is a support porch, which serves as a guide to a nail file rested against the support porch. On the sides of the shape walls, there is an indentation or depression to accommodate the lateral movement of the digit so that proper blending of the side of the nail can be achieved. At the ends of the shape walls, raised side rests limit the lateral displacement of the digit. The base of each digit rest is preferably curved to accommodate the natural flexure of the digit. The curvature also inhibits lateral movement of the flexed digit. Importantly, the tip of the shape wall is curved to conform generally to the natural lateral curvature of the nail. The nail filing guide is generally made of some non-slip relatively durable material which is resistive to solvents and abrasion. For storage purposes, the ends of the digit rests may be flattened so that the structure can rest in a stable, upright position.

A nail filing guide, according to the present invention, allows an unskilled user to reliably and repeatedly shape a nail in a simple, straightforward and low-cost manner. Other advantages of the invention will be apparent from the following detailed description in connection with the accompanying drawings.

DESCRIPTION OF THE SPECIFIC EMBODIMENTS

Referring to FIGS. 1, 5, 7, and 9, four different embodiments of the structure are shown in perspective. Referring to FIGS. 2, 6, 8, and 10, the same four different embodiments are shown in top-plan view, respectively. The following description will describe the figures citing common features, except where indicated.

Figure 1:
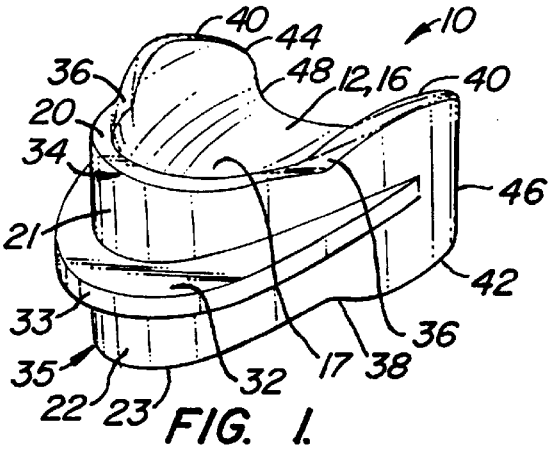
FIG. 1 is a perspective view of a first embodiment of a nail filing guide according to the invention.
Figure 3:
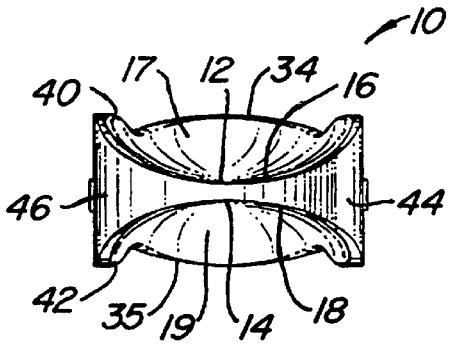
FIG. 3 is a rear elevational view of a first embodiment of the invention.
Figure 2:
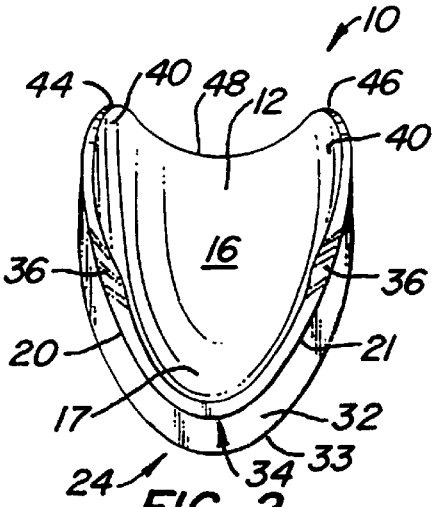
FIG. 2 is a top plan view of a first embodiment of the invention.
Figure 4:
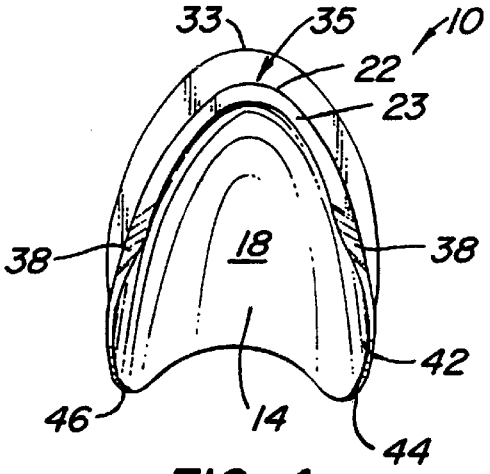
FIG. 4 is a bottom plan view of a first embodiment of the invention.
Figure 5:
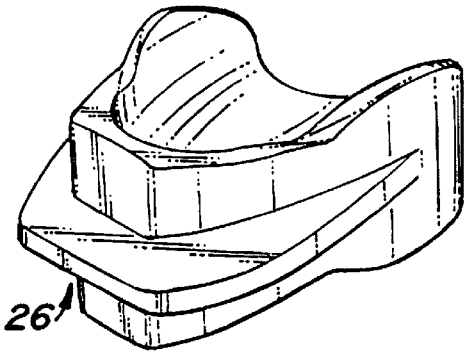
FIG. 5 is a perspective view of a second embodiment of the invention.
Figure 6:
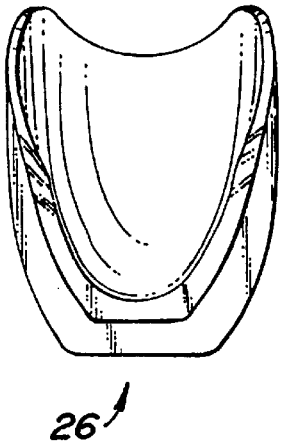
FIG. 6 is a top plan view of the second embodiment of the invention.
Figure 7:
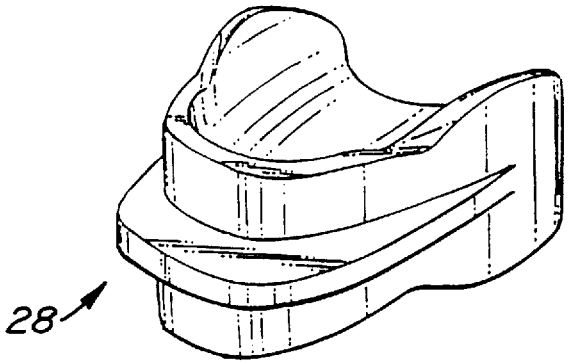
FIG. 7 is a perspective view of a third embodiment of the invention.
Figure 8:
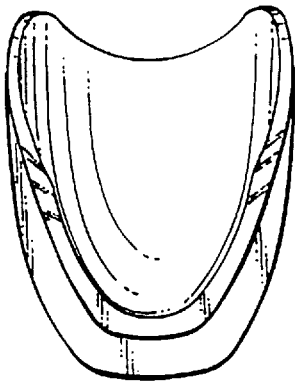
FIG. 8 is a top plan view of a third embodiment of the invention.
Figure 9:
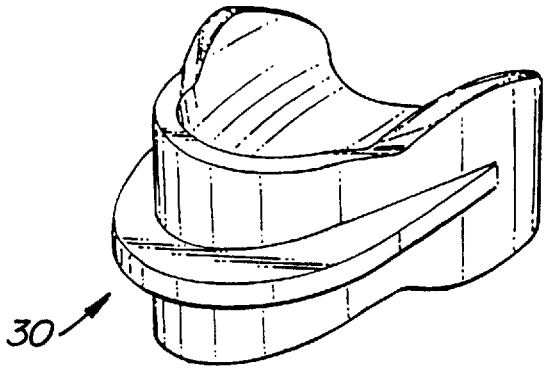
FIG. 9 is a perspective view of a fourth embodiment of the invention.
Figure 10:
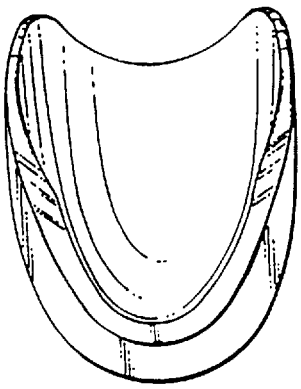
FIG. 10 is a top plan view of a fourth embodiment of the invention.

The structure is a nail filing guide 10 in the form of a grippable structure comprising a first digit rest 12 and an opposing second digit rest 14, separated by a concave floor 16, 18 on each side. Bounding the first digit rest and the second digit rest 12, 14 are shape walls 20, 22 with the inner contour 17, 19 generally conforming to the shape of a digit and the outer contour 21, 23 conforming to the desired shape of the finished nail. Each of the embodiments has a different shape. FIG. 1 and FIG. 2 represent the embodiment having a generally pointed outer contour 24. FIG. 5 and FIG. 6 represent the embodiment having a generally blunt outer contour 26. FIG. 7 and FIG. 8 represent the embodiment having a generally opaque outer contour 28, and FIG. 9 and FIG. 10 represent the embodiment having a generally round outer contour 30. It will be noted that the shape wall thickness may be chosen to best accommodate the desired length of the nail, although this thickness is not a critical dimension, since the digit has enough natural flexibility to allow for different placement within the digit rest 12, 14. (It is assumed that the digit is held in place for the length of the manicure or pedicure process so that a consistent shape can be obtained.) Importantly, the outer contour 21, 23 is angled perpendicular to the growth pattern of the nail. The filing of a nail perpendicular to the growth pattern is important to promote strength in the nails. It has been found that nails shaped at a non-perpendicular angle to the growth pattern are more susceptible to breakage.

A flange or porch 32 is provided to serve as a guide to a nail file and to separate opposing sides of the structure so that a different shape wall contour on each side can be provided. The flange 32 also assures that the nail file is guided along a repeatable path. The outer edge 33 of the porch 32 also may serve as an identifier of the shape of outer contour 21, 23, the outer edge 33 conforming generally to the shape of the outer contour 21, 23 for easy identification. Alternatively, the structure could be a different color or a label could be provided on the structure itself to identify the shape of the outer contour 21, 23.

The tip 34, 35 of the shape wall 20, 22 is also important. The shape wall 20, 22 is not only shaped to define the cut of the nail, its tip 34, 35 is chosen to generally conform to the lateral curvature of the nail so that no air pockets are formed under the nail as the nail is shaped. By contacting the tip 34, 35 across the underside of the nail, the tip 34, 35 improves the quality and consistency of the cut across the nail. The tip 34, 35 may also serve as a natural rest for a nail extending over the edge of the profile of the shape wall. In addition, indentations 36 and 38 are provided along the lateral profile of the shape wall 20, 22 to permit the lateral rotation of the digit so that the sides of the nail can be properly blended. However, side rests 40, 42 are provided to limit the lateral displacement of the digit, and to provide a foundation for the ends 44 and 46. Ends 44, 46 are generally flattened so that the structure 10 can stand on end. The structure 10 itself is preferably constructed of a non-slip finished material resistant to solvents and the like, and of sufficient durability to resist the corrosion of a nail file resting upon the surface. However, recognizing that diamond files are extremely corrosive, these structures 10 are subject to normal wear and tear. Finally, an indentation 48 is provided on the floors 12, 14 to accommodate the natural flexure of the digit.

The invention has now been explained with reference to specific embodiments. Other embodiments will be apparent to those of ordinary skill in the art. It is therefore not intended that this invention be limited, except as indicated by the appended claims.

What is claimed is:

1. A nail filing guide, particularly for fingernails, comprising:

a digit rest having a proximal end and a distal end; and a shape wall superimposed along the distal end of the digit rest, said shape wall having an outer contour shaped to define a desired nail distal end shape.

2. A nail filing guide as claimed in claim 1, wherein said outer contour of the shape wall is disposed substantially perpendicular to a nail position to ensure that a file riding on said outer contour contacts a nail distal end at a substantially perpendicular angle.

3. A nail filing guide as claimed in claim 1, wherein the outer contour of the distal end is generally pointed.

4. A nail filing guide as claimed in claim 1, wherein the outer contour of the distal end is generally blunt.

5. A nail filing guide as claimed in claim 1, wherein the outer contour of the distal end is generally opaque.

6. A nail filing guide as claimed in claim 1, wherein the outer contour of the distal end is generally round.

7. A nail filing guide as claimed in claim 1, wherein the shape wall further includes a distal tip of a convex shape which conforms to the general lateral curvature of the nail, wherein the distal tip is for contacting the the underside of the nail for supporting the nail to produce an even filing.

8. A nail filing guide as claimed in claim 1, wherein the shape wall along the digit rest further includes a concave inner contour, said inner contour conforming generally to the curvature of the distal end of the digit.

9. A nail filing guide comprising:

a digit rest having a proximal end and a distal end;

a shape wall superimposed along the distal end of the digit rest, said shape wall having an outer contour shaped to define a desired nail distal end shape; and a support porch extending outwardly along the shape wall, wherein the support porch comprises an outer edge, said support porch is for ensuring that a file does not slip laterally.

10. A nail filing guide as claimed in claim 9, wherein the outer edge of the support porch has generally the same shape as the outer contour of the distal tip.

11. A nail filing guide as claimed in claim 1, further comprising depressions positioned on the shape wall along the digit rest, said depressions are for permitting lateral rotation of the digit for shaping of the side of the nail.

12. A nail filing guide as claimed in claim 11, wherein the shape wall along the digit rest further comprises side rests positioned proximal of the depressions, said side rests are for limiting the amount of lateral displacement of the digit.

13. A nail filing guide as claimed in claim 1, wherein the digit rest further comprises an indentation on the proximal end, said indentation accommodates the natural flexure of the digit.

14. A nail filing guide as claimed in claim 1, wherein the digit rest further comprises flat portions on the proximal end, said flat portions support the nail filing guide in an upright position.

15. A nail filing guide as claimed in claim 1, wherein the shape wall has a thickness corresponding to a minimum length of the nail.

16. A nail filing guide comprising:

a digit rest having a proximal end and a distal end;

a shape wall superimposed along the distal end of the digit rest, said shape wall having an outer contour shaped to define a desired nail distal end shape; and an opposing digit rest.

17. A nail filing guide as claimed in claim 16, wherein the opposing digit rest is a different size than the first digit rest.

18. A nail filing guide as claimed in claim 16, further comprising an opposing shape wall superimposed along the distal end of the opposing digit rest.

19. A nail filing guide comprising:

a first digit rest having a distal end and a proximal end;

a second digit rest having a distal end and a proximal end, said second digit rest opposes the first digit rest;

a first shape wall superimposed on the distal end of the first digit rest having, an outer contour defining a desired nail shape, said outer contour forces a file to contact the nail at a substantially perpendicular angle, an inner contour conforming generally to the contour of the digit tip, and a distal tip conforming generally to a natural curvature of the nail;

a second shape wall superimposed on the distal end of the second digit rest having, an outer contour defining a desired nail shape, said outer contour forces a file to contact the nail at a substantially perpendicular angle, an inner contour conforming generally to the contour of the digit tip, and a distal tip conforming generally to a natural curvature of the nail;

an indentation on the proximal end of the first and second digit rests, said indentation accommodates the natural flexure of the digit;

depressions on the first and second shape walls, said depressions allow lateral movement of the digit to ensure proper blending of the side nail;

side rests on the first and second shape walls, positioned proximal of the depressions, said side rests limit the lateral displacement of the digit; and a support porch extending outward from the intersection of the shape walls further comprising an outer surface, said support porch ensures that the file does not slip laterally;

wherein the outer surface has the same general shape as the outer contour.

20. A method for filing nails comprising:

placing a digit in a nail filing guide;

selecting a desired length of a nail;

contacting the nail along a top contour;

pressing a file against an outer contour of the filing guide and the nail end;

maintaining a substantially perpendicular angle between the file and the nail end by riding the file along the outer contour; and shaping the nail distal end to the desired shape.

* * * * *